US005591041A

United States Patent [19]

Cecil, Jr. et al.

[11] Patent Number: 5,591,041

[45] Date of Patent: Jan. 7, 1997

[54] ELECTRICAL CONNECTOR POSITION ASSURANCE SYSTEM

[75] Inventors: Paul D. Cecil, Jr., Joliet; Scott P. Marceau, Naperville, both of Ill.

[73] Assignee: Molex Incorporated, Lisle, Ill.

[21] Appl. No.: 407,304

[22] Filed: Mar. 20, 1995

[51] Int. Cl.[6] ..... H01R 13/627

[52] U.S. Cl. ..... 439/352

[58] Field of Search ..... 439/352, 353, 439/347, 188, 357, 329, 731, 492, 499

[56] References Cited

U.S. PATENT DOCUMENTS 5,275,575 1/1994 Cahaly et al. ..... 439/352

5,314,345 5/1994 Cahaly et al. ..... 439/352

*Primary Examiner*—P. Austin Bradley

*Assistant Examiner*—Yong Kim

*Attorney, Agent, or Firm*—A. A. Tirva

[57] ABSTRACT

A connector position assurance system is provided for an electrical connector adapted to mate with another mateable connecting device. The connector includes a housing having an interior cavity. A flexible locking arm is provided on the housing and is adapted for locking engagement with appropriate lock means of the mateable connecting device. The locking arm is flexibly movable between a locking position when the connector is fully mated with the device inwardly to an unlocking position of incomplete mating of the connector with the device. A locking member is mounted substantially within the interior cavity of the connector housing and includes an actuating portion exposed exteriorly of the housing. The locking member is movable between a first position allowing movement of the locking arm and mating of the connector and the device, and a second position blocking inward movement of the locking arm away from its locking position when the connector and the device are fully mated. The locking arm in its unlocking position of incomplete mating of the connector and the device blocks movement of the locking member from its first position to its second position, thereby indicating that the connector and the device are not fully mated.

18 Claims, 3 Drawing Sheets

ELECTRICAL CONNECTOR POSITION ASSURANCE SYSTEM

FIELD OF THE INVENTION

This invention generally relates to the art of electrical connectors and, particularly, to a connector position assurance system for an electrical connector adapted to mate with another mateable connecting device.

BACKGROUND OF THE INVENTION

Electrical connectors normally require secure mechanical and electrical engagement between one electrical connector and a mateable electrical connector or other mateable connecting device. Various latching systems have been used with electrical connectors to provide such secure engagement. Such systems usually provide this secure engagement with ease of attachment and detachment. For instance, latching mechanisms have been developed which include pivotally supported latching arms that interlock with each other or that interlock with a complementary latching mechanism of the mateable connector or connecting device.

In addition, connector position assurance devices also are known in the art. Typically, the primary function of such devices is to verify that the connectors are fully mated and latched, i.e. that the latching mechanisms are fully or securely engaged. A secondary function often is to prevent the latching mechanisms from inadvertently unlatching and permitting the connectors to separate. These connector position assurance functions may be accomplished in a variety of ways, but most prior art connector position assurance systems employ a spacer that cannot be inserted into its intended position unless the latching arm is fully engaged, and the latching arm cannot be moved when the spacer is properly positioned. Problems often are encountered with such removable spacers because they may be lost or misplaced. Therefore, in some position assurance systems, the spacers may be preloaded on the connector housing so that they cannot be lost or misplaced. However, one of the problems with such systems is that the preloaded spacer often is mounted substantially on the outside of the connector housing which significantly increases the overall size of the connector and also locates the spacer where it can catch on extraneous objects during handling.

For example, U.S. Pat. No. 5,314,345 to Cahaly, dated May 24, 1994, shows an electrical connector system for use in a vehicle occupant inflatable restraint ("airbag") system wherein it is highly desirable to assure that the electrical connector system is fully mated. Such a connector system for use in an airbag system incorporates a so-called shorting clip arranged to electrically short together the leads within a plug connector before the plug and mating jack are mated. The connector system includes a position assurance locking element or spacer which is tethered to the connector housing so that it does not become lost or misplaced. However, the tethered locking element is prone to catch on all kinds of extraneous objects, during manufacture, shipping and handling.

The present invention is directed to solving these problems by providing an electrical connector position assurance system wherein the position assurance locking member not only is preloaded on the connector housing, but the locking member actually is incorporated within the connector housing itself.

SUMMARY OF THE INVENTION

An object, therefore, of the invention is to provide a new and improved connector position assurance system for an electrical connector adapted to mate with another mateable connecting device.

In the exemplary embodiment of the invention, the connector includes a housing mounting terminal means for interconnection with appropriate terminal means of the mateable connecting device. The housing includes an interior cavity. A flexible locking arm is provided on the housing and adapted for locking engagement with appropriate lock means of the mateable connecting device. The locking arm is flexibly movable between a locking position when the connector is fully mated with the device inwardly to an unlocking position of incomplete mating of the connector with the mateable connecting device.

The invention contemplates that the locking member be mounted substantially within the interior cavity of the connector housing, with only an actuating portion of the locking member exposed exteriorly of the housing. The locking member is movable between a first position allowing movement of the locking member and mating of the connector and the device and a second position blocking movement of the locking arm from its locking position when the connector and the device are fully mated. The locking arm in its unlocking position of incomplete mating of the connector and the device blocks movement of the locking member from its first position to its second position, thereby indicating that the connector and the device are not fully mated.

As disclosed herein, a pair of the flexible locking arms are provided on the housing, with the arms being flexibly movable toward each other to respective unlocking positions of incomplete mating of the connector and the device. The locking member is movable to its second position between the pair of locking arms when the arms are in their locking positions, thereby blocking movement of the arms toward each other. The pair of locking arms have distal ends projecting from the connector housing to, at least in part, define a plug portion of the connector insertable into an appropriate socket of the mateable connecting device.

Other features of the invention include complementary interengaging detent means between the locking member and the connector housing for holding the locking member in its second position. The locking member is mounted on the housing for sliding movement between its first and second positions. The terminal means on the connector housing includes a flexible circuit sandwiched between the locking member and an interior wall of the interior cavity of the housing.

Still further, in the preferred embodiment of the invention, the connector housing is a two-part structure defining the interior chamber between first and second parts of the housing. Complementary interengaging latch means are provided between the first and second parts of the housing to hold the parts in assembled condition. The complementary interengaging latch means include at least one flexible latch arm on one of the housing parts engageable in a latching position with a latch on the other housing part. Generally, the locking member blocks movement of the latch arm away from its latching position when the locking member is in its second position. Specifically, a pair of the flexible latch arms are flexibly movable toward each other to unlatching positions, and the locking member blocks movement of the latch arms to the unlatching position when the locking member is in its second position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
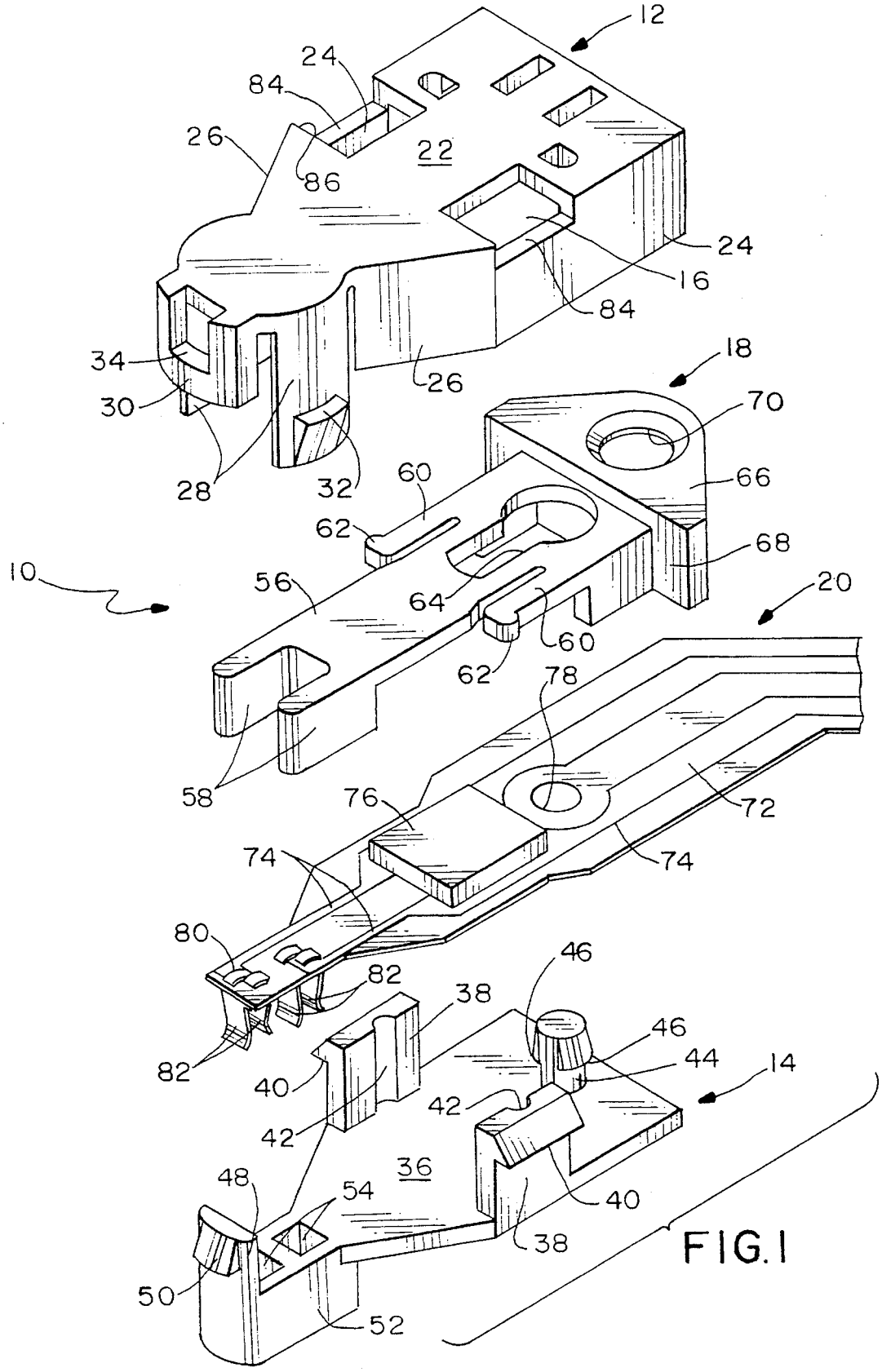
FIG. 1 is an exploded perspective view of an electrical connector embodying the connector position assurance system of the invention.
Figure 2:
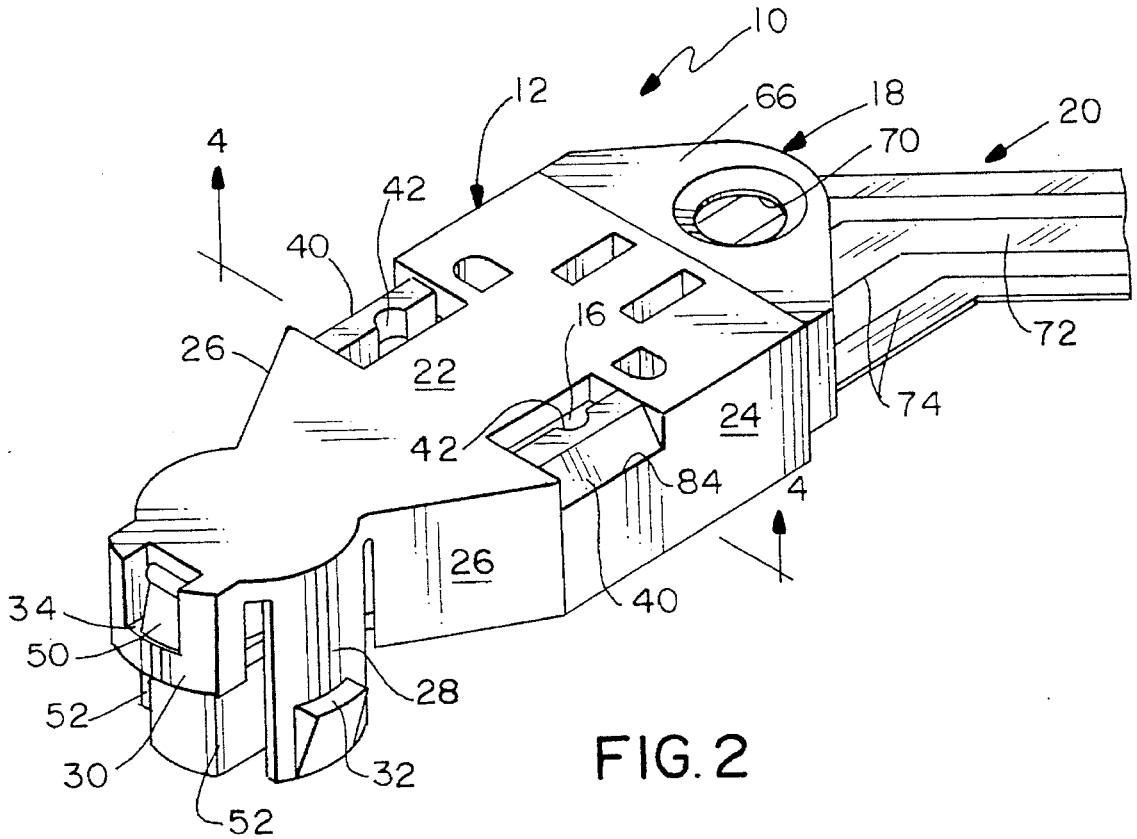
FIG. 2 is a perspective view of the connector in assembled condition.

Referring to the drawings in greater detail, and first to FIGS. 1 and 2, the connector position assurance system is embodied in an electrical connector, generally designated 10, adapted to mate with another mateable connecting device. Generally, the connector includes a two-part connector housing defined by a first or upper housing part, generally designated 12, and a second or lower housing part, generally designated 14. The two housing parts are interconnectable to define an interior cavity 16 within which is slidably mounted a locking member, generally designated 18, of the connector position assurance system. Terminal means, generally designated 20, are mounted within the connector for interconnection with appropriate terminal means of the mateable connecting device.

More particularly, upper housing part 12 includes a top wall 22 and a pair of side walls 24 defining three sides of interior cavity 16. The front of the cavity is bounded by tapered side walls 26 which lead to a nose portion of upper housing part 12 defined by a pair of side flexible locking arms 28 and a front nose latch 30. Each locking arm 28 has a chamfered locking boss 32, and nose latch 30 has an aperture defining a latch shoulder 34.

Lower housing part 14 includes a planar portion 36 which defines the bottom wall of cavity 16. A pair of flexible latch arms 38 project upwardly from bottom wall 36. Each latch arm includes an outwardly projecting latching flange 40, and a vertical detent channel 42 is formed on the inside of each latch arm. A locating post 44, having latching lips 46 projects upwardly from bottom wall 36 at the rear thereof. A nose latching arm 48, including a latching lip 50, projects upwardly at the front of a nose portion 52 of lower housing part 14. Lastly, a pair of apertures 54 extend through nose portion 52.

Figure 3:
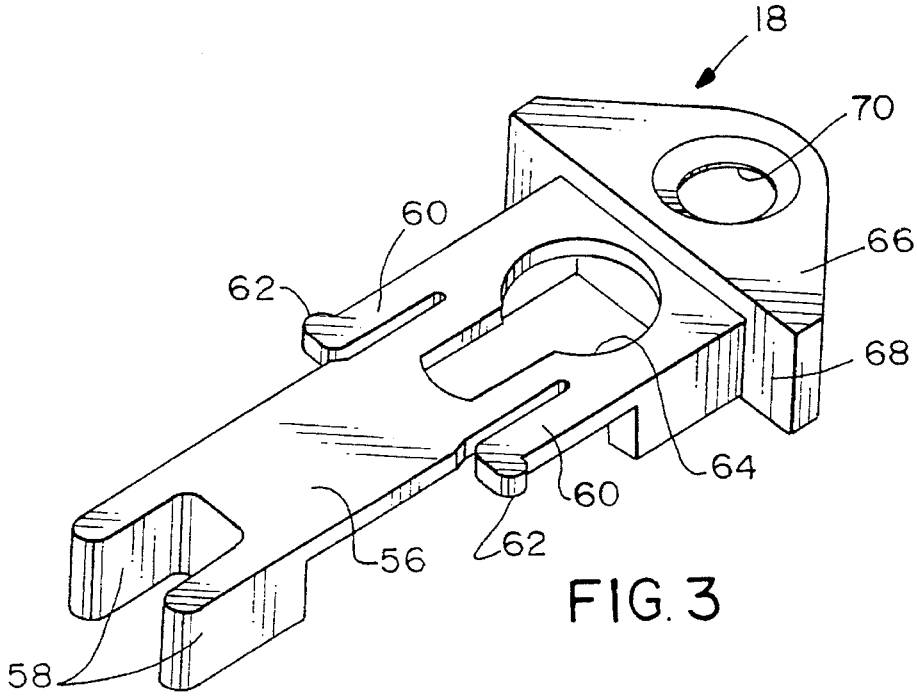
FIG. 3 is a perspective view of the locking member of the connector position assurance system.

Referring to FIG. 3 in conjunction with FIGS. 1 and 2, locking member 18 includes a tongue 56 which has a bifurcated distal end defining a pair of forwardly projecting, laterally spaced blocking flanges 58. A pair of flexible latch arms 60 are located on the outside of tongue 56. The flexible latch arms have outwardly projecting, rounded detents 62. A keyhole-shaped aperture 64 is formed in tongue 56 at the rear thereof. Lastly, locking member 18 has an enlarged rear portion 66 defining a front wall 68 which closes cavity 16 of the connector housing. As will be seen hereinafter, substantially the entirety of locking member 18, including tongue 56, blocking flanges 58, flexible latch arms 60 and detents 62 are located within the interior cavity 16 of the two-part connector housing, with only rear portion 66 of the locking member exposed exteriorly of the housing. To that end, a chamfered hole 70 is formed in rear portion 66 of the locking member to facilitate sliding movement of the locking member as described hereinafter.

Terminal means 20 basically comprises a flexible circuit 72 having circuit traces 74 thereon. The flexible circuit may include one or more electrical components, such as a chip 76. The flexible circuit is positionable on top of bottom wall 36 of lower housing part 14 by means of an aperture 78 in the flexible circuit snapping over latching lips 46 on locating post 44. When properly positioned, the flexible circuit is sandwiched within the connector housing between locking member 18 and bottom wall 36 of the lower housing part. Lastly, the flexible circuit includes a forwardly projecting nose portion 80 which overlies nose portion 52 of lower housing part 14. Circuit traces 74 are electrically coupled to pairs of depending conductive terminals 82 which project into apertures 54 through nose portion 52 of the lower housing part. When the connector is mated with the mateable connecting device, appropriate terminal pins, for instance, project into apertures 54 for electrical interengagement with terminals 82.

FIG. 2 shows connector 10 in assembled condition with the upper and lower housing parts interengaged. It can be seen that latching lip 50 of nose latching arm 48 (FIG. 1) of the lower housing part has snapped into engagement with shoulder 34 of nose latch 30 of the upper housing part. In addition, latching flanges 40 of latch arms 38 (FIG. 1) of the lower housing part have snapped into engagement with a pair of shoulders 84 defined by a pair of apertures 86 (FIG. 1) formed in the upper housing part. In this assembled condition of the upper and lower housing parts of connector 10, it can be seen in FIG. 2 that the only portion of locking member 18 which is exposed exteriorly of the housing is the rear portion 66 thereof. It also can be seen in FIG. 2 that nose portion 52 of the lower housing part and flexible locking arms 28 of the upper housing part combine to define a downwardly projecting plug portion of the connector which is insertable into an appropriate socket of the mateable connecting device (not shown). The socket, in turn, would include the terminal means for interengagement with terminals 82 (FIG. 1) of flexible circuit 72.

Figure 4:
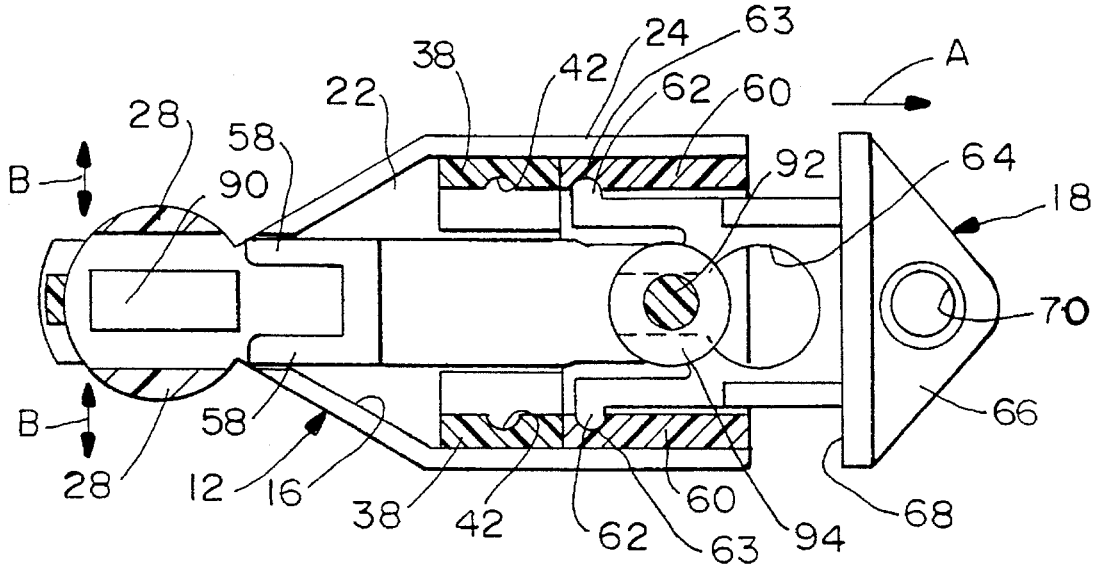
FIG. 4 is a horizontal section taken generally along line 4—4 of FIG. 2, with the locking member in its first position allowing mating of the connector.
Figure 5:
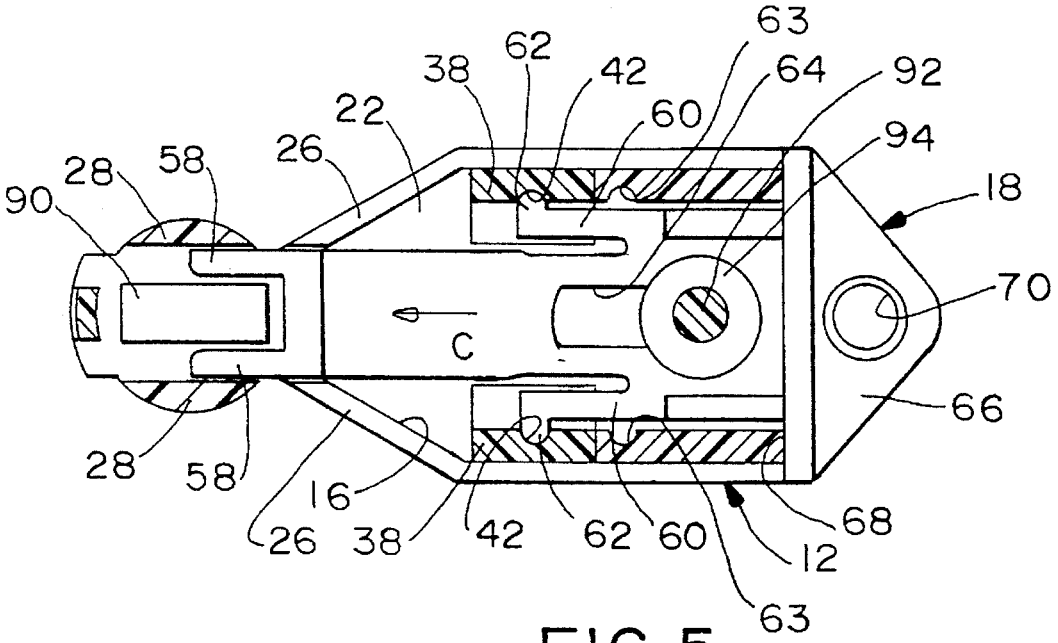
FIG. 5 is a view similar to that of FIG. 4, with the locking member in its second position blocking movement of the locking arms to prevent unmating of the connector.

Before proceeding with a detailed description of the operation of the connector position assurance system of the invention in conjunction with FIGS. 4 and 5, a general description will be presented. Specifically, flexible locking arms 28 on upper housing part 12 are adapted for locking engagement with appropriate lock means of the mateable connecting device. In particular, locking bosses 32 on the outsides of the flexible locking arms interengage with locks on the device. The locking arms are flexibly movable between locking positions shown in FIG. 2 when the connector is fully mated with the device, inwardly to unlocking positions of incomplete mating of the connector with the device. Locking member 18 is movable between a first position allowing movement of the locking arms and mating of the connector and the device, to a second position shown in FIG. 2 wherein blocking flanges 58 at the front of the locking member block inward movement of the locking arms away from their locking positions when the connector and the device are fully mated. The locking arms in their unlocking positions of incomplete mating of the connector with the device will block movement of the locking member from its first position to its second position, thereby indicating that the connector and the device are not fully mated.

More particularly, referring to FIGS. 4 and 5, locking member 18 is shown in FIG. 4 in its first position pulled rearwardly of the connector housing in the direction of arrow "A" wherein the detents 62 on the flexible latch arms 60 engage detent recesses 63 located in the side walls 24 of the upper housing 12. In this position, flexible locking arms 28 are free to flex inwardly and outwardly in the direction of double-headed arrows "B" in order to mate and unmate the connector with the mateable connecting device.

Once the connector is fully mated with the device, locking member 18 is pushed inwardly in the direction of arrow "C" to its second position shown in FIG. 5. In this second position of locking member 18, it can be seen that blocking flanges 58 at the front of the locking member have moved to positions inside flexible locking arms 28. Therefore, the flexible locking arms cannot flex inwardly and unmating of the connector with the device is prohibited. Although not visible in FIGS. 1 and 2, it can be seen in FIGS. 4 and 5 that a rectangular boss 90 is molded integrally with the underside of top wall 22 of upper housing part 12 between flexible locking arms 28. The boss is spaced sufficiently inwardly from the flexible locking arms to allow blocking flanges 58 of locking member 18 to move forwardly between boss 58 and the flexible locking arms to provide a rigid abutment between the parts which absolutely prevents the locking arms from flexing inwardly. The rectangular boss also acts as an anti-overstress means to prevent excessive inward flexing of blocking flanges 58.

FIGS. 4 and 5 also show a post 92 projecting downwardly from top wall 22 of upper housing part 12 through keyhole-shaped aperture 64 in locking member 18. The post has a circular enlargement 94 which can pass through the enlarged portion of the keyhole-shaped aperture to facilitate mounting the locking member within interior cavity 16 of the housing. The narrow longitudinal portion of the keyhole-shaped aperture allows the locking member to slide between its first and second positions shown in FIGS. 4 and 5, respectively.

Still further, FIG. 5 shows that detents 62 on the distal ends of flexible latch arms 60 of locking member 18 have moved into detent channels 42 on the insides of latch arms 38. This not only provides a tactile indication of the full forward or second position of locking member 18, but latch arms 60 on the locking member prevent inward movement of latch arms 38 on lower housing part 14 and, thereby, prevent unlatching of the two housing parts when the locking member is in its operative second position.

Lastly, it can be understood that if flexible locking arms 28 are flexed inwardly to positions which would indicate incomplete mating of connector 10 with the mateable connecting device, the inward flexed positions of the locking arms would block movement of locking member 18 from its first position (FIG. 4) to its second position (FIG. 5). In other words, if the locking arms were flexed inwardly, the front tips of blocking flanges 58 of locking member 18 would abut against the locking arms. Since the locking member would not be movable to its full forward position, a clear indication would be given that the connector is not fully mated with the mateable connecting device.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A connector position assurance system for an electrical connector adapted to mate with another mateable connecting device, comprising:

said connector including a housing and terminal means for mounting in said housing adapted for interconnection with appropriate terminal means of the mateable connecting device, the housing including an interior cavity;

a flexible locking arm on the housing adapted for locking engagement with appropriate lock means of the mateable connecting device, the locking arm being flexibly movable between a locking position when the connector is fully mated with the device inwardly to an unlocking position of incomplete mating of the connector with the mateable connecting device;

a locking member including an actuating portion exposed exteriorly of the housing, the locking member being movable between a first position allowing movement of the locking arm and mating of the connector and the device and a second position blocking inwardly movement of the locking arm away from its locking position when the connector and the device are fully mated, said locking member being integrally retained substantially within the interior cavity of the connector housing while the locking member is in the first position; and said locking arm in its unlocking position of incomplete mating of the connector with the device blocking movement of the locking member from its first position to its second position and thereby indicating that the connector and the device are not fully mated.

2. The connector position assurance system of claim 1, including complementary interengageable detent means between the locking member and the connector housing for holding the locking member in its second position.

3. The connector position assurance system of claim 1, including means slidably mounting the locking member on the housing for sliding movement between its first and second positions.

4. The connector position assurance system of claim 1 wherein said terminal means on the connector housing includes a flexible circuit sandwiched between the locking member and an interior wall of said interior cavity of the housing.

5. The connector position assurance system of claim 1, including a pair of said flexible locking arms which are flexibly movable toward each other to respective unlocking positions of incomplete mating of the connector and the device, said locking member being movable to its second position between the pair of locking arms when the arms are in their locking positions and thereby blocking movement of the arms toward each other.

6. The connector position assurance system of claim 5 wherein said pair of locking arms have distal ends projecting from the connector housing to, at least in part, define a plug portion of the connector insertable into an appropriate socket of the mateable connecting device.

7. The connector position assurance system of claim 1 wherein said connector housing is a two-part structure defining said interior cavity between first and second parts of the housing.

8. The connector position assurance system of claim 7, including complementary interengaging latch means between said first and second parts of the housing to hold the parts in assembled condition.

9. The connector position assurance system of claim 8 wherein said complementary interengaging latch means include at least one flexible latch arm on one of the housing parts engageable in a latching position with a latch on the other housing part, said locking member blocking movement of the latch arm away from its latching position when the locking member is in its second position.

10. The connector position assurance system of claim 9, including a pair of said flexible latch arms which are flexibly movable toward each other to unlatching positions, said locking member blocking movement of the latch arms to the unlatching positions when the locking member is in its second position.

11. A connector position assurance system for an electrical connector adapted to mate with another mateable connecting device, comprising:

said connector including a housing having an interior cavity defined between a top wall and a bottom wall of the housing;

a pair of flexible locking arms on the housing and projecting therefrom to define a plug portion of the connector adapted for insertion into an appropriate socket of the mateable connecting device and for locking engagement therewith, the locking arms being flexibly movable between a locking position when the connector is fully mated with the device inwardly toward each other to an unlocking position of incomplete mating of the connector with the device;

a locking member integrally retained substantially within the interior cavity of the connector housing and including an actuating portion exposed exteriorly of the housing, the locking member including a locking portion remote from said actuating portion and movable between a first position allowing movement of the locking arms and mating of the connector and the device and a second position between the locking arms blocking inward movement of the arms when the connector and the device are fully mated; and said locking arms in their unlocking positions of incomplete mating of the connector with the device blocking movement of the locking member from its first position to its second position and thereby indicating that the connector and the device are not fully mated.

12. The connector position assurance system of claim 11, including complementary interengageable detent means between the locking member and the connector housing for holding the locking member in its second position.

13. The connector position assurance system of claim 11, including means slidably mounting the locking member on the housing for sliding movement between its first and second positions.

14. The connector position assurance system of claim 11 wherein said terminal means on the connector housing includes a flexible circuit sandwiched between the locking member and an interior wall of said interior cavity of the housing.

15. The connector position assurance device of claim 11 wherein said connector housing is a two-part structure defining said interior cavity between first and second parts of the housing.

16. The connector position assurance system of claim 15, including complementary interengaging latch means between said first and second parts of the housing to hold the parts in assembled condition.

17. The connector position assurance system of claim 16 wherein said complementary interengaging latch means include at least one flexible latch arm on one of the housing parts engageable in a latching position with a latch on the other housing part, said locking member blocking movement of the latch arm away from its latching position when the locking member is in its second position.

18. The connector position assurance system of claim 17, including a pair of said flexible latch arms which are flexibly movable toward each other to unlatching positions, said locking member blocking movement of the latch arms to the unlatching positions when the locking member is in its second position.

* * * * *